United States Patent [19]

Cummins et al.

[11] Patent Number: 4,756,291

[45] Date of Patent: Jul. 12, 1988

[54] PRESSURE CONTROL FOR THE FUEL SYSTEM OF AN INTERNAL COMBUSTION ENGINE

[75] Inventors: James M. Cummins, Dearborn; John G. Wilson, Lincoln Park; John J. Lubinski, Livonia, all of Mich.

[73] Assignee: Ford Motor Company, Dearborn, Mich.

[21] Appl. No.: 42,509

[22] Filed: Apr. 27, 1987

[51] Int. Cl.[4] ..... F02M 37/08

[52] U.S. Cl. ..... 123/497; 417/45

[58] Field of Search ..... 123/497; 417/45, 44

[56] References Cited

U.S. PATENT DOCUMENTS

| | | | |
|---|---|---|---|
| 3,584,977 | 6/1971 | Coleman, II et al. | 417/44 X |
| 3,827,409 | 8/1974 | O'Neill | 123/458 |
| 4,248,194 | 2/1981 | Drutehae et al. | 123/357 |
| 4,260,333 | 4/1981 | Schillinger | 123/458 |
| 4,281,968 | 8/1981 | Akers | 417/44 X |
| 4,330,238 | 5/1982 | Hoffman | 417/45 X |

OTHER PUBLICATIONS

SAE 821202, "Carburetor Foaming and Its Influence on the Hot Weather Performance of Motor Vehicles", Tertois et al (1982).

*Primary Examiner*—William E. Tapolcai

*Attorney, Agent, or Firm*—Allan J. Lippa; Peter Abolins

[57] ABSTRACT

A fuel system for an internal combustion engine wherein the fuel pressure is maintained within a desired predetermined range. An electric fuel pump supplies fuel at a pressure proportional to the electric power applied to the pump. Control circuitry compares a voltage signal corresponding to the fuel pressure within a predetermined voltage range corresponding to a predetermined fuel pressure range. When the voltage signal is below the predetermined voltage range, the electric power applied to the electric pump is increased; when the voltage signal is above the predetermined voltage range, the electric power applied to the electric pump is decreased. The control circuit may further increase or decrease the electric power at a predetermined rate.

11 Claims, 2 Drawing Sheets

PRESSURE CONTROL FOR THE FUEL SYSTEM OF AN INTERNAL COMBUSTION ENGINE

BACKGROUND OF THE INVENTION

The invention relates generally to controlling the fuel pressure in the fuel system of an internal combustion engine.

Recent trends in motor vehicle fuel efficiency and emission control have increased the temperature of fuel delivered to an internal combustion engine. Elevated temperatures and the corresponding elevation in fuel pressure may result in rapid fuel vaporization, or foaming, when the fuel encounters a sudden pressure drop such as, for example, when entering the fuel bowl of a carburetor.

Fuel foaming in a carburetor has been found to create particularly troublesome problems (see, SAE Technical Paper 821202, entitled "Carburetor Foaming And Its Influence On The Hot Weather Performance Of Motor Vehicles", by V. M. Tertois and B. D. Caddock, 1982). For example, the foam may cause the carburetor float to sink leaving the fuel inlet valve open. Excessive fuel is then forced by the fuel pump into the carburetor bowl and into the engine through both the main jet and the carburetor internal vent. Further, the foam may block the carburetor inlet vent thereby increasing the pressure within the bowl. Any one of the above conditions will likely result in an overfueled engine and associated drivability problems.

Present motor vehicle fuel systems may also underfuel an internal combustion engine. In a carbureted system, for example, the fuel inlet valve has a fixed cross-sectional area. At a constant fuel pump pressure, the volume of fuel flow into the bowl is therefore constant. Accordingly, when a full throttle condition is initiated, the fuel in the bowl may become temporarily depleted thereby underfueling the engine.

A prior approach to regulating the fuel pressure comprised a mechanical pressure valve coupled to the carburetor fuel inlet, and a return fuel line coupled between the fuel tank and the pressure valve. A disadvantage of this approach is that the valve restriction adds to the temperature of the fuel, and also may entrain air within the fuel, thereby increasing the likelihood of fuel foaming at the carburetor bowl. The return fuel line and fuel circulated therethrough also increases fuel temperature.

U.S. Pat. No. 4,260,333 discloses another approach for a fuel injection system wherein the excess fuel not required for injection is returned to the fuel reservoir. The electrical power supplied to the fuel pump is altered continuously in an attempt to maintain the fuel pressure at a single fixed value. A system of this type, however, is inherently prone to oscillations in fuel pressure around the fixed pressure value.

There still remains a need for a fuel system wherein fuel pressure variations which would cause underfueling or overfueling are avoided. Further, a need remains for a fuel system wherein the drivability of a motor vehicle is not subject to rapid variations.

SUMMARY OF THE INVENTION

In accordance with an embodiment of the invention, the above and other problems are overcome by maintaining the fuel pressure in the fuel system within a desired predetermined range or operating window above atmospheric such that the engine is neither underfueled or overfueled and oscillations in the fuel pressure are also avoided. Further, by regulating the pump pressure, the need for the return fuel line and associated disadvantages of the prior approaches is eliminated. More specifically, the electric power supplied to the electric fuel pump is increased when the fuel pressure falls below a predetermined range. In a similar manner, the electric power is decreased when the fuel pressure rises above the predetermined range. When the fuel pressure is within the predetermined range, the electric power is not changed, thereby avoiding rapid perturbations or oscillations in the fuel pressure.

A further aspect of the invention is that the electric power supplied to the electric fuel pump is increased or decreased at a predetermined rate to prevent both fuel pressure overshoot and undershoot beyond the predetermined pressure range.

An additional aspect of the invention is that the pressure range is maintained with reference to the ambient pressure around the engine thereby ensuring proper fuel system operation at all altitudes.

DESCRIPTION OF THE PREFERRED EMBODIMENT

Figure 1:
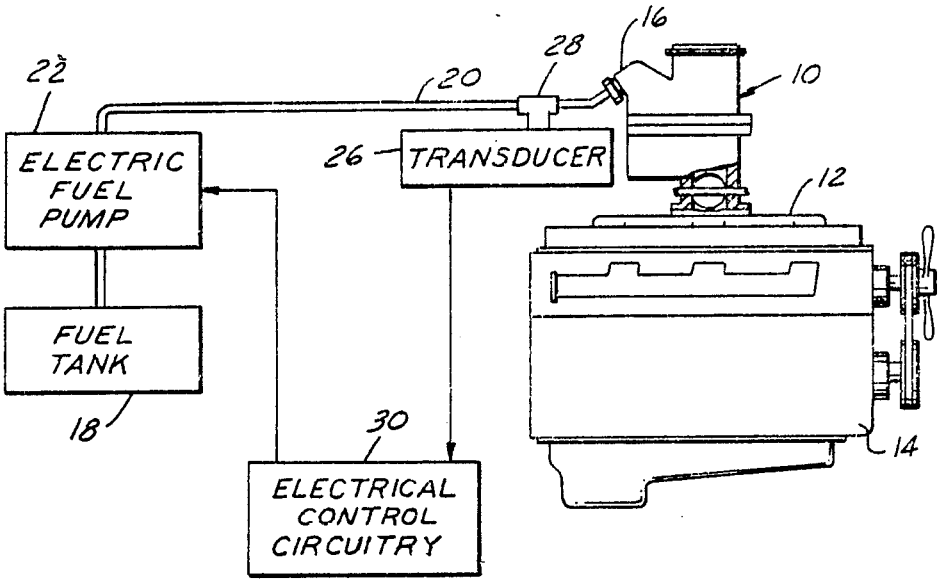
FIG. 1 is a block diagram of a fuel system wherein the invention is used to advantage.

Referring first to FIG. 1, a block diagram of a fuel system coupled to an internal combustion engine is shown wherein the invention may be used to advantage. More specifically, a conventional carburetor 10 is shown coupled to the input manifold 12 of internal combustion engine 14. Fuel inlet end 16 of carburetor 10 is shown coupled to fuel tank 18 through fuel line 20 and electric fuel pump 22. Preferably, for reasons described hereinafter, fuel pump 22 is a high volume centrifugal pump without a check valve having a 100 gallon per hour capacity at 15 psi. Pressure transducer 26, here shown as a pressure to voltage transducer, supplied by Omega Engineering, Inc., Stamford, Conn., is coupled to fuel line 20 through tee 28. Pressure transducer 26 provides electrical control circuitry 30 with a voltage signal $E_S$ proportional to the fuel pressure at carburetor inlet 16. Preferably, pressure transducer 26 is referenced to the ambient pressure such that its output does not vary with altitude.

As described in greater detail hereinafter, with particular reference to FIGS. 2, 3A and 3B, fuel pump 22 pumps fuel through line 20 at a pressure proportional to the electric power supplied by electrical control circuitry 30. In general terms, when the fuel pressure falls below a predetermined fuel pressure range, electrical control circuitry 30 gradually increases electric power at a predetermined rate. Similarly, when the fuel pressure rises above the predetermined fuel pressure range, electrical power is gradually decreased at a predetermined rate.

Figure 2:
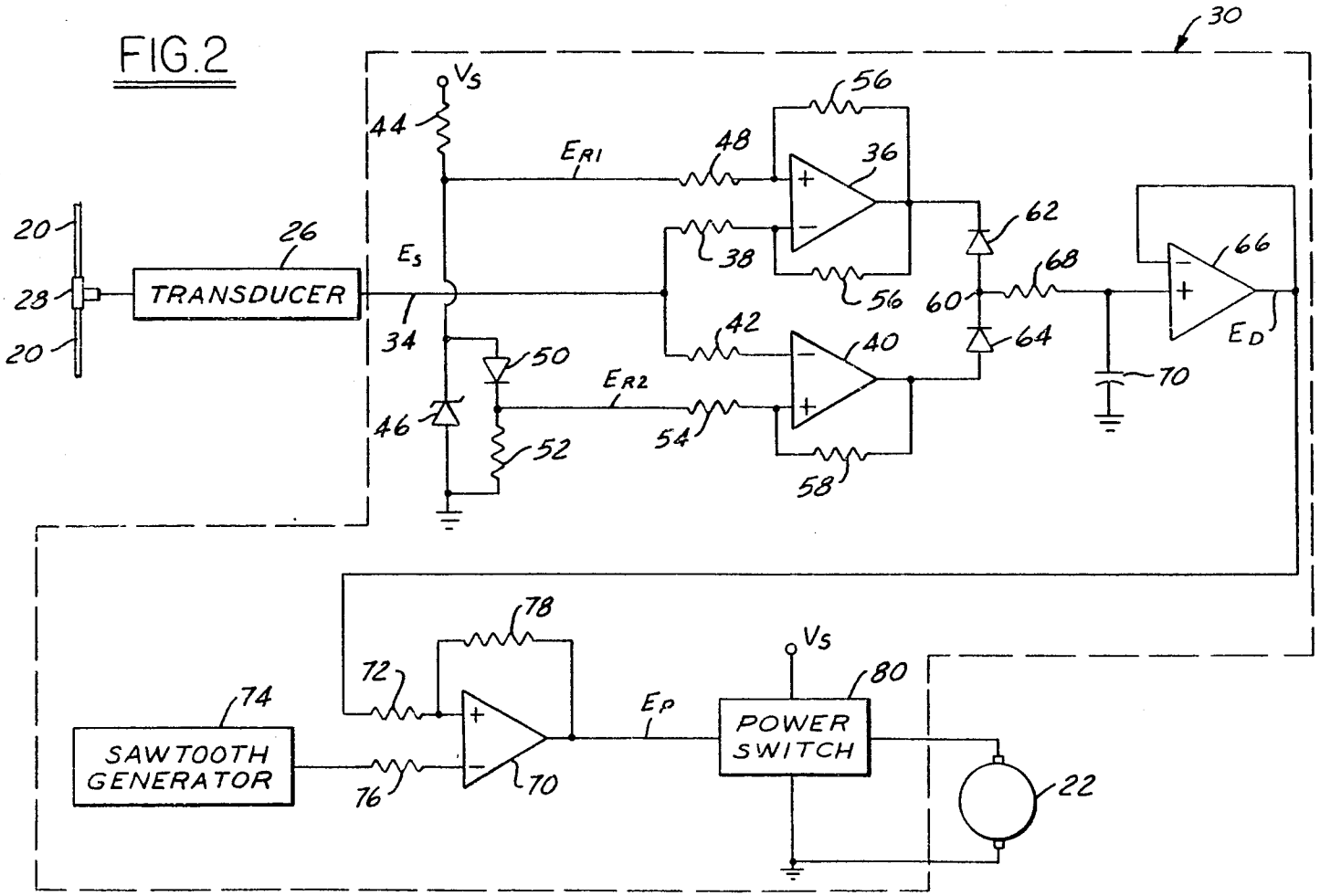
FIG. 2 is an electrical schematic of the corresponding components shown in FIG. 1.

Referring now to FIG. 2, voltage signal $E_S$ from pressure transducer 26 is coupled to the negative input terminal of voltage comparator 36 through resistor 38. $E_S$ is also shown coupled to the negative input terminal of voltage comparator 40 through resistor 42.

Resistor 44 and zener diode 46 are coupled to voltage source $V_S$ in a conventional manner to generate a first reference voltage $E_{R1}$ which is coupled to the positive input terminal of voltage comparator 36 through resistor 48. Similarly, diode 50 and resistor 52 are coupled to $E_{R1}$ in a conventional manner to generate a second reference voltage $E_{R2}$ which is coupled to the positive input terminal of voltage comparator 40 through resistor 54.

Resistor 56 and resistor 58 are each shown coupled between the output and input terminals of voltage comparator 36 and voltage comparator 40, respectively, to set a predetermined hysterisis in each of the voltage comparators. The output of voltage comparator 36 is also shown coupled to terminal 60 through the cathode of series diode 62. Similarly, the output of voltage comparator 40 is coupled to terminal 60 through the anode of series diode 64. Terminal 60 is shown coupled to the input of driver 66 through the RC circuit of resistor 68 and capacitor 70.

Figure 3A:
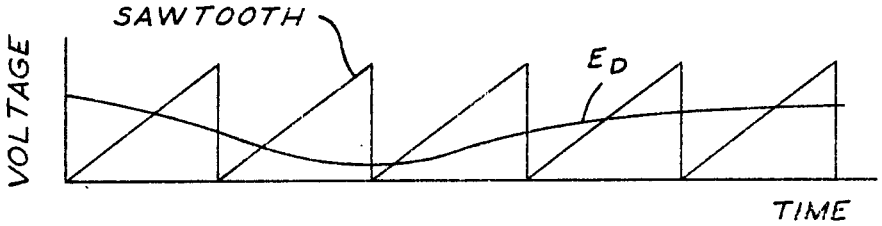
FIGS. 3A and 3B illustrate electrical wave forms associated with the operation of electrical components illustrated in FIG. 2.
Figure 3B:
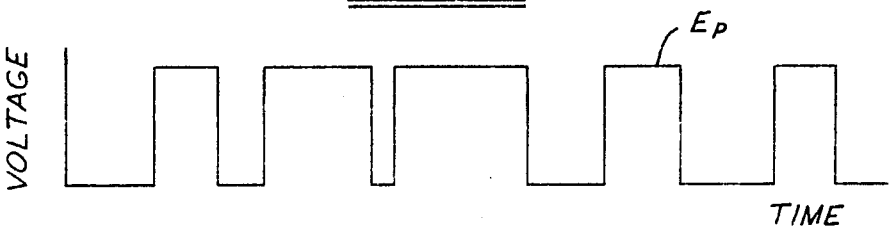

Continuing with FIG. 2, and also referring to FIGS. 3A and 3B, driver 66 provides output voltage $E_D$ to the positive input terminal of voltage comparator 70 through resistor 72. The negative input terminal of voltage comparator 70 is coupled to sawtooth generator 74 through resistor 76. Feedback resistor 78, shown coupled from the output to the positive input of voltage comparator 70, sets the hysterisis of voltage comparator 70 in a conventional manner. Accordingly, voltage comparator 70 compares the voltage levels of $E_D$ and the sawtooth signal, as illustrated in FIG. 3A, to generate a voltage pulse signal $E_P$, as illustrated in FIG. 3B, the pulse width of $E_P$ being a function of the voltage amplitude of $E_D$.

Power switch 80, preferably including a power transistor coupled to a voltage source $V_S$ and responsive to $E_P$, provides electric power to the electric motor (not shown) of electric fuel pump 22, the electric power being switched or modulated between $V_S$ and zero volts as a function of $E_P$.

The operation of the embodiment illustrated hereinabove is now described with respect to specific operating parameters such as fuel pressure and voltage. However, these operating parameters are presented for illustrative purposes only and should not be construed as limiting to the scope of the invention.

In operation, the illustrated embodiment maintains the fuel pressure at carburetor inlet 16 within a predetermined range of between 3.5–3.0 psi. Since pressure transducer 26 converts this pressure range into a corresponding voltage range of between 4.7–4.0 volts, reference voltages $E_{R1}$ and $E_{R2}$ are respectively set at 4.7 and 4.0 volts.

During high fuel pressure conditions, voltage signal $E_S$ from pressure transducer 26 may rise above 4.7 volts. Voltage comparator 36 will then turn on, discharging capacitor 70 through resistor 68 and diode 62 at rate determined by the RC time constant of resistor 68 and capacitor 70. The RC time delay prevents overshoot in the pressure correction when the normal operating range is abruptly exceeded, such as when engine temperatures become excessive. Accordingly, when the fuel pressure exceeds 3.5 psi, the output voltage $E_D$ of driver 66 will gradually decrease thereby decreasing the pulse width of the voltage applied to electric fuel pump 22. The fuel pressure at the carburetor inlet 16 will then gradually decrease back into the desired predetermined pressure range.

During low fuel pressure conditions, $E_S$ may fall below 4.0 volts. Both voltage comparator 36 and voltage comparator 40 will then be in the off or high voltage output state. Capacitor 70 will be charged by voltage comparator 40 through diode 64 and resistor 68 at a rate also determined by the RC time constant of resistor 68 and capacitor 70. In this case, the RC time constant prevents overshoot when the fuel pressure abruptly falls below the predetermined pressure range such as when a full throttle condition is first introduced. Thus, when the fuel pressure falls below 3 psi, $E_D$ will gradually increase thereby increasing the pulse width of the voltage applied to electric fuel pump 22. The fuel pressure at carburetor inlet 16 will then gradually increase back into the desired predetermined pressure range.

When the fuel pressure is within the predetermined pressure range, voltage comparator 36 will be in the off or high voltage output state and voltage comparator 40 will be in the on or zero voltage output state. Both diode 62 and diode 64 will then be in the nonconducting state. $E_D$ and the pulse width of the voltage applied to electric fuel pump 22 will therefore remain substantially constant. Accordingly, when the fuel pressure at carburetor inlet 16 is within the predetermined range associated with normal operating conditions, corrections by the electric control circuitry which may cause undesirable fuel pressure oscillations are avoided.

During conditions when fuel pump 22 is off, the fuel in line 20 will flow backwards through fuel pump 22 into the fuel tank 18. Accordingly, there is no entrapped fuel within line 20 which may otherwise evaporate after a heated engine is shut off.

This concludes the description of the preferred embodiment. The reading of it by those skilled in the art will bring to mind many alterations and modifications without departing from the spirit and scope of the invention. For example, the invention may be used to advantage in electronic fuel injected engines, wherein it is also desirable to regulate fuel pressure and eliminate the need for a return fuel line to the fuel tank. Accordingly, it is intended that the scope of the invention be limited only by the following claims.

We claim:

1. A method for maintaining the fuel pressure in an internal combustion engine fuel system within a predetermined pressure range, comprising the steps of:

pumping fuel through the fuel system with an electric pump at a fuel pressure proportional to the electric power supplied to said fuel pump;

converting said fuel pressure into a corresponding voltage signal;

comparing said voltage signal to a low voltage reference and a high voltage reference defining a predetermined voltage range corresponding to the predetermined fuel pressure range;

increasing the electric power supplied to said elelctric fuel pump when the magnitude of said voltage signal is less than said predetermined voltage range;

decreasing the electric power supplied to said electric fuel pump when the magnitude of said voltage signal is more than said predetermined voltage range; and maintaining the electric power supplied to said electric fuel pump substantially constant when said voltage signal is within said predetermined voltage range.

2. The method recited in claim 1, wherein the electric power supplied to said electric fuel pump is increased at a predetermined rate.

3. An apparatus for maintaining the fuel pressure in an internal combustion engine fuel system within a predetermined pressure range, comprising:

an electric fuel pump for pumping fuel through the fuel system at a pressure proportional to the electric power applied to said electric fuel pump;

conversion means for converting said fuel pressure to a corresponding voltage signal;

comparison means for comparing said voltage signal to a low voltage reference and to a high voltage reference defining a predetermined voltage range corresponding to the predetermined fuel pressure range; and control means responsive to said comparison means for increasing the electric power supplied to said electric fuel pump when the magnitude of said voltage signal is less than said predetermined voltage range and for decreasing the electric power supplied to said electric fuel pump when the magnitude of said voltage signal is more than said predetermined voltage range and for maintaining the electric power supplied to said electric fuel pump substantially constant when the magnitude of said voltage signal is within said predetermined voltage range.

4. The apparatus recited in claim 3, wherein said control means both increases and decreases said electric power at a predetermined rate.

5. The apparatus recited in claim 4, wherein said predetermined rate is determined by an RC time constant.

6. An apparatus for maintaining the fuel pressure in an internal combustion engine fuel system within a predetermined pressure range, comprising:

an electric fuel pump for pumping fuel through the fuel system at a pressure proportional to the electric power applied to said electric fuel pump;

conversion means coupled to the fuel system for converting said fuel pressure into a corresponding voltage signal;

comparison means coupled to said voltage signal for comparing said voltage signal to a low voltage reference and to a high voltage reference defining a predetermined voltage range corresponding to the predetermined fuel pressure range; and supply means responsive to said comparison means for supplying electric power to said electric fuel pump, said supply means supplying substantially constant electric power when said voltage signal is within said predetermined voltage range, said supply means supplying increased electric power when said voltage signal is below said predetermined voltage range, and said supply means supplying decreased electric power when said voltage signal is above said predetermined voltage range.

7. An apparatus for maintaining the fuel pressure in the fuel system of an internal combustion engine within a predetermined range, comprising:

a carburetor having a fuel inlet;

an electric fuel pump for pumping fuel into said carburetor inlet at a pressure proportional to the electric power supplied to said electric fuel pump;

a pressure transducer coupled to said carburetor inlet for converting actual fuel pressure into a corresponding voltage signal;

reference means for providing a low voltage reference corresonding to the minimum pressure desired in the fuel system and for providing a high voltage reference corresponding to the maximum pressure desired in the fuel system, the difference between said low voltage reference and said high voltage reference defining a predetermined voltage range corresponding to said predetermined pressure range;

comparison means coupled to both said voltage signal and said reference means for comparing said voltage signal to said predetermined voltage range; and supply means responsive to said comparison means for supplying electric power to said electric fuel pump, said supply means supplying substantially constant electric power when said voltage signal is within said predetermined voltage range, said supply means gradually increasing the electric power when said voltage signal is below said predetermined voltage range, and said supply means gradually decreasing the electric power when said voltage signal is above said predetermined voltage range.

8. The apparatus recited in claim 7, wherein said supply means supplies pulse width modulated electric power to said electric pump.

9. The apparatus recited in claim 8, wherein the electric power supplied to said electric fuel pump is increased by increasing the pulse width of the electric power.

10. The apparatus recited in claim 7, wherein said electric fuel pump comprises a centrifugal vane pump.

11. The apparatus recited in claim 7, wherein said pressure transducer is referenced to the ambient pressure around the internal combustion engine.

* * * * *